US008328383B2

(12) United States Patent
Lien

(10) Patent No.: US 8,328,383 B2
(45) Date of Patent: Dec. 11, 2012

(54) TRANSPARENT CONTAINER WITH IMAGE PRESENTATION ARRANGEMENT

(76) Inventor: Chin-Hsiung Lien, El Monte, CA (US)

( * ) Notice: Subject to any disclaimer, the term of this patent is extended or adjusted under 35 U.S.C. 154(b) by 340 days.

(21) Appl. No.: 12/799,405

(22) Filed: Apr. 22, 2010

(65) Prior Publication Data

US 2010/0296273 A1 Nov. 25, 2010

Related U.S. Application Data

(60) Provisional application No. 61/216,797, filed on May 20, 2009.

(51) Int. Cl.
*F21V 33/00* (2006.01)

(52) U.S. Cl. ..... 362/154; 362/157

(58) Field of Classification Search ..... 362/101, 362/154, 157; 220/602, 608
See application file for complete search history.

(56) References Cited

U.S. PATENT DOCUMENTS 4,344,113 A * 8/1982 Ditto et al. ..... 362/101
6,921,179 B2 * 7/2005 Diak Ghanem ..... 362/101
6,923,549 B2 * 8/2005 Hoy ..... 362/101

* cited by examiner

*Primary Examiner* — David V Bruce
(74) *Attorney, Agent, or Firm* — Raymond Y. Chan; David and Raymond Patent Firm

(57) ABSTRACT

A container includes a container body and an image presentation arrangement. The container body includes a solid base and a surrounding wall, wherein the solid base has a refraction face at a bottom face of the solid base and a viewing face at an outer surrounding face of the solid base to define a refraction angle between the refraction face and the viewing face. The image presentation arrangement includes one or more characters integrally formed at the refraction face of the solid base, wherein the virtual images of the characters are projected on the viewing surface by means of refraction for enhancing a decorative aesthetic appearance of the container body.

20 Claims, 5 Drawing Sheets

TRANSPARENT CONTAINER WITH IMAGE PRESENTATION ARRANGEMENT

CROSS REFERENCE OF RELATED APPLICATION

This is a non-provisional application of a provisional application having an application No. 61/216,797 and a filing date of May 20, 2009.

BACKGROUND OF THE PRESENT INVENTION

1. Field of Invention

The present invention relates to a container, and more particularly to a transparent container with image presented.

2. Description of Related Arts

Many liquid or solid containers are decorated by patterns and images on the walls thereof for aesthetic appearance or for indication. For example, water class and wine class are having patterns curved on the outer walls; marks have characters or sentences printed on the outer wall.

All these methods have to work on the wall of the container. Most possibly, the wall is the thinnest and weakest portion of a container. Therefore, any painting, curving, wearing, or other work on the wall cost the risk to break the wall and damage the container. Some treatments can not be performed over the wall, for example, deep curving. And for some treatments, there are many limitations such as the pattern's area and features. Some times, the thickness of the wall has to be increased, or the material of the wall has to be changed. These will introduce high cost, and incontinence of using.

Also, some containers are highly concerned about the aesthetic appearance, such as crystal glass, perfume container, artistic vase, etc. Any marks or labels one the wall will damage the integral appearance.

Compare to the wall, the bottom is always the thickest porting of a container, and consequently, it is much more robust. It can afford different kinds of treatment to achieve a larger range of effects. Also, any marks or labels on the bottom will not be disturbing in appearance. But for conventional containers, the pattern on the bottom is invisible and most of the time is only used for less important indication, such as model number or fabricator. It is a kind of waste that can not utilize the bottom portion to present valuable image and patterns.

SUMMARY OF THE PRESENT INVENTION

The main object of the present invention is to provide a container which can present images on the wall.

Another object of the present invention is to improve the aesthetic appearance of a container.

Another object of the present invention is to provide a container which has the images prepared on the bottom thereof.

Another object of the present invention is to provide a container which can afford different kinds of treatment to prepare the image.

Another object of the present invention is to provide a container which doesn't affect the physical condition of the wall when prepare and present the image.

Another object of the present invention is to provide a container which is easy and cost saving to present image.

In order to accomplish the above objects, the present invention provides a container, comprising:

a container body having a solid base having a predetermined thickness, and a surrounding wall upwardly extended from the base to define a container cavity, wherein the base comprises a bottom concave face extending upwardly to define a refraction angle between the surrounding wall and the bottom concave face; and an image presentation arrangement which comprises a refraction surface on the peripheral of the bottom concave face, a viewing surface of the outer wall of the base, and one or more characters formed on the refraction surface and configured in an inversed manner, wherein the virtual images of the characters are projected on the viewing surface by means of refraction for enhancing a decorative aesthetic appearance of the container body.

These and other objectives, features, and advantages of the present invention will become apparent from the following detailed description, the accompanying drawings, and the appended claims.

DETAILED DESCRIPTION OF THE PREFERRED EMBODIMENT

Figure 1:
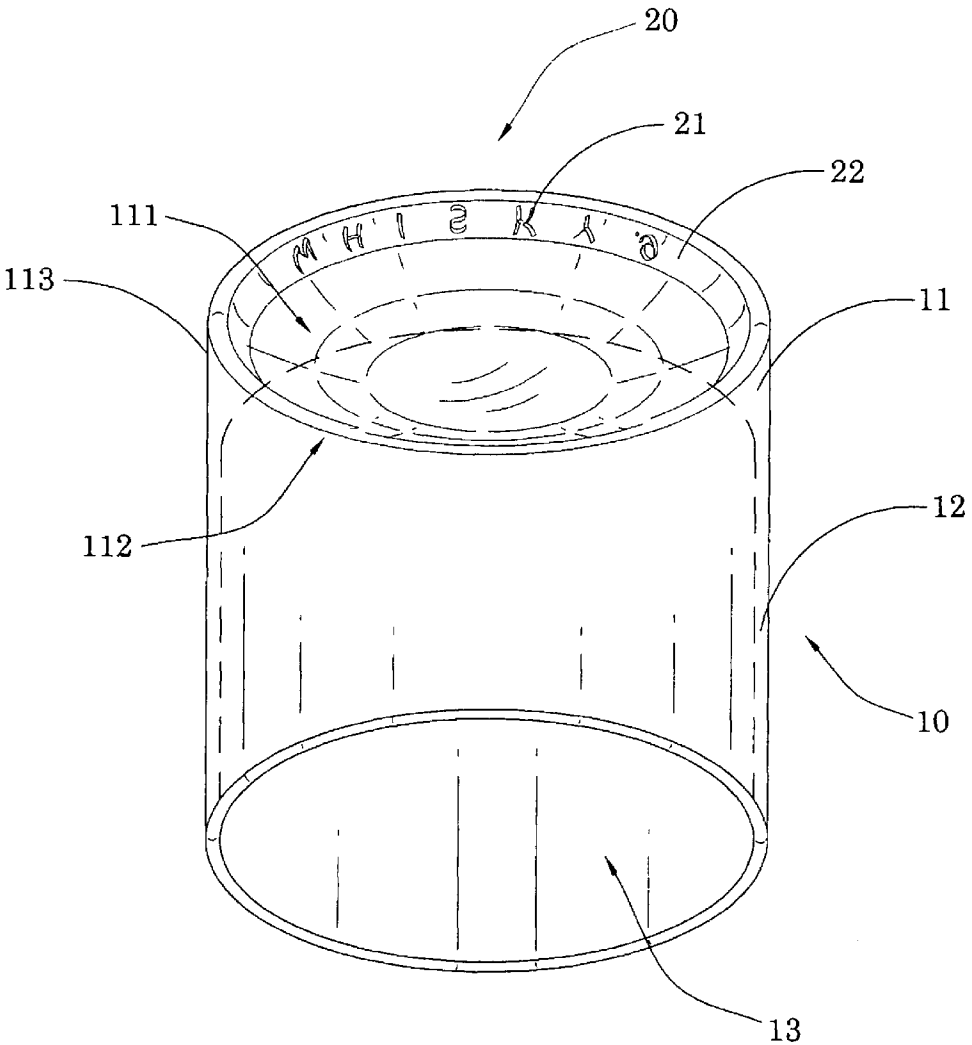
FIG. 1 is a perspective view of the container of the present invention illustrating the bottom of the container.
Figure 2:
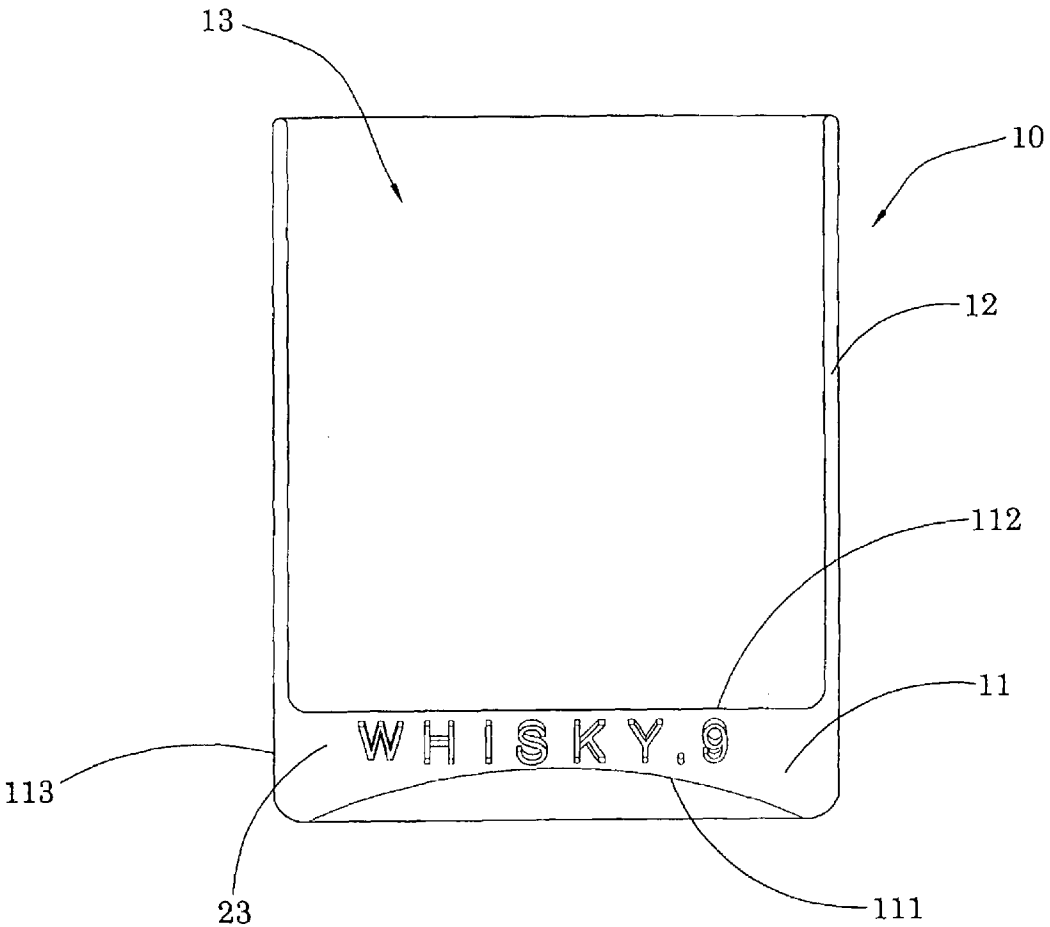
FIG. 2 is a side view of an embodiment of the present invention illustrating the image presentation.
Figure 3:
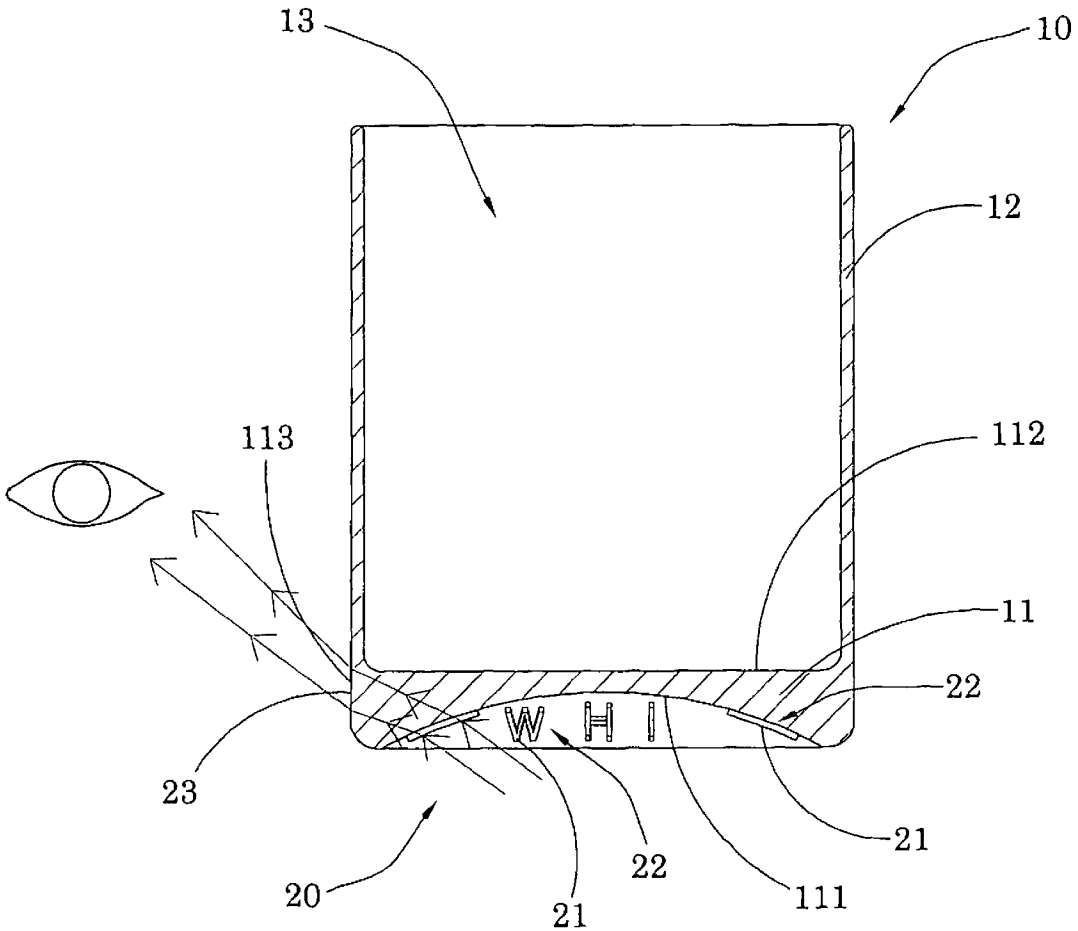
FIG. 3 is a sectional view of an embodiment of the present invention.

Referring to FIGS. 1 to 3 of the drawings, in a preferred embodiment of the present invention, the container comprises a container body 10 and an image presentation arrangement 20. The container body 10 further comprises a solid base 11 and a surrounding wall 12. The surrounding wall 12 is extending upwardly from the peripheral of the solid base 11 to define a container cavity 13. This cavity provides the containing function of the container.

The solid base 11 of the container is made of transparent material, for example, glass, crystal, plastic, acryl, etc. Preferably, the surrounding wall 12 is made of the same material, but alternatively, the upper portion of the surrounding wall 12 can be made of different material, including opaque material.

Figure 4:
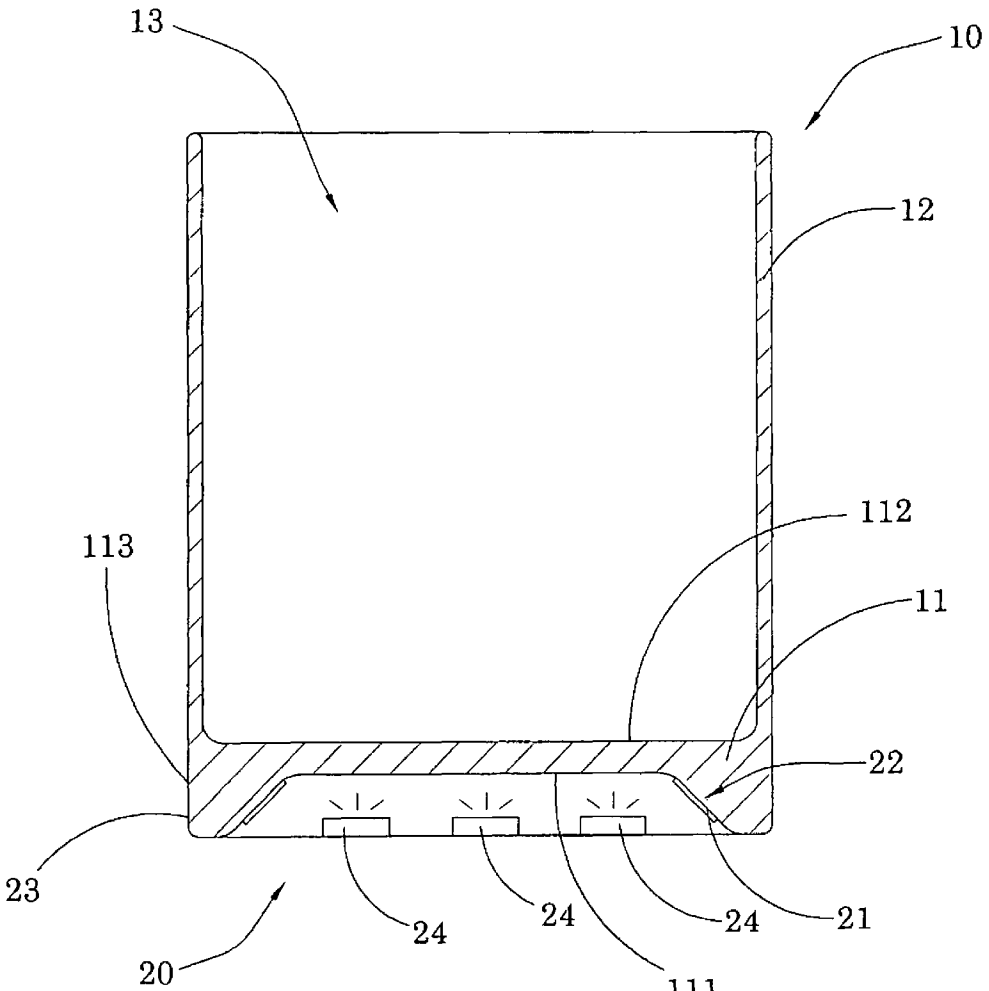
FIG. 4 is a sectional view of an alternative embodiment of the present invention.

The solid base 11 further comprises a bottom concave face 111, a top face 112, and a surrounding face 113. The top face 112 is on the top of the base 11. The bottom concave face 111 is on the bottom of the base 11. The surrounding face 113 is on the out surface of the base 11 and is continuously extending to the surrounding wall 12. The bottom concave face 111 is not a flat plane and is concaved upwardly from the peripheral of the solid base 11. Referring to FIGS. 2 to 4, the peripheral portion of the bottom concave face 111 is inclined upwardly towards the top face 112 and forms the refraction surface 22 of the image presentation arrangement 20. The surrounding face 113 also provides a viewing face 23 thereon. The refraction face 22 and the viewing face 23 define a refraction angle 15. It is easy to see the refraction angle 15 is less than the angle between the surrounding face 113 and the ground level where the container stands. Referring to FIGS. 3 and 4, the contour of the bottom concave face 111 may be different. For example, it could be a curve, or a trapezoid. The contour of the refraction face 22 can be linear, and also can be curved. As shown in FIG. 4, the bottom face 111 of the solid base 11 has a trapezoid shape defining a top flat surface and an inclined flat surface, wherein the image presentation arrangement 20 is formed the inclined flat surface of the bottom face 111 of the solid base 11. The refraction angle 15 is also different for different embodiment. The refraction face 22 and the viewing face 23 can be parallel which means the refraction angle is 0. Compare with a container having a flat bottom, the embodiment of the present invention has a smaller angle between the bottom face and the surrounding face 113 at the edge, and the refraction face 22 on the bottom concave face 111 is closer to the viewing face 23. It is worth mentioning, the top face 112 of the solid base 11 can have different contour, such as flat or curved surface. But the solid base 11 needs to maintain a certain thickness at the peripheral thereof to provide enough area for the viewing face 23.

Referring to FIGS. 1 to 4, the container of the present invention also comprises an image presentation arrangement 20. The image presentation arrangement 20 comprises one or more characters 21 formed on the bottom concave face 111 of the solid base 11, a refraction face 22 formed on the bottom concave face 111, and a viewing face 23 formed on the surrounding face of the solid base 10. Preferably, these image characters 21 are formed on the refraction face 22. The image characters 21 can be formed on the solid base 11 by different methods. For example, the image characters 21 can be formed by embossment, engraving, or enchasing. In a preferred embodiment, the image characters 21 are formed by embossment. The features of the characters 21 are protruded from the solid base. The cross section of the features is rectangular, therefore the refraction and reflection effects of light ray cooperated with the particular material of the container provide a special effect to high light the characters 21. Alternatively, the cross section of the features is triangle, curve, or other shape. In an alternative embodiment, the image characters 21 are painted on the refraction face 22. Different colors are provided.

Figure 5:
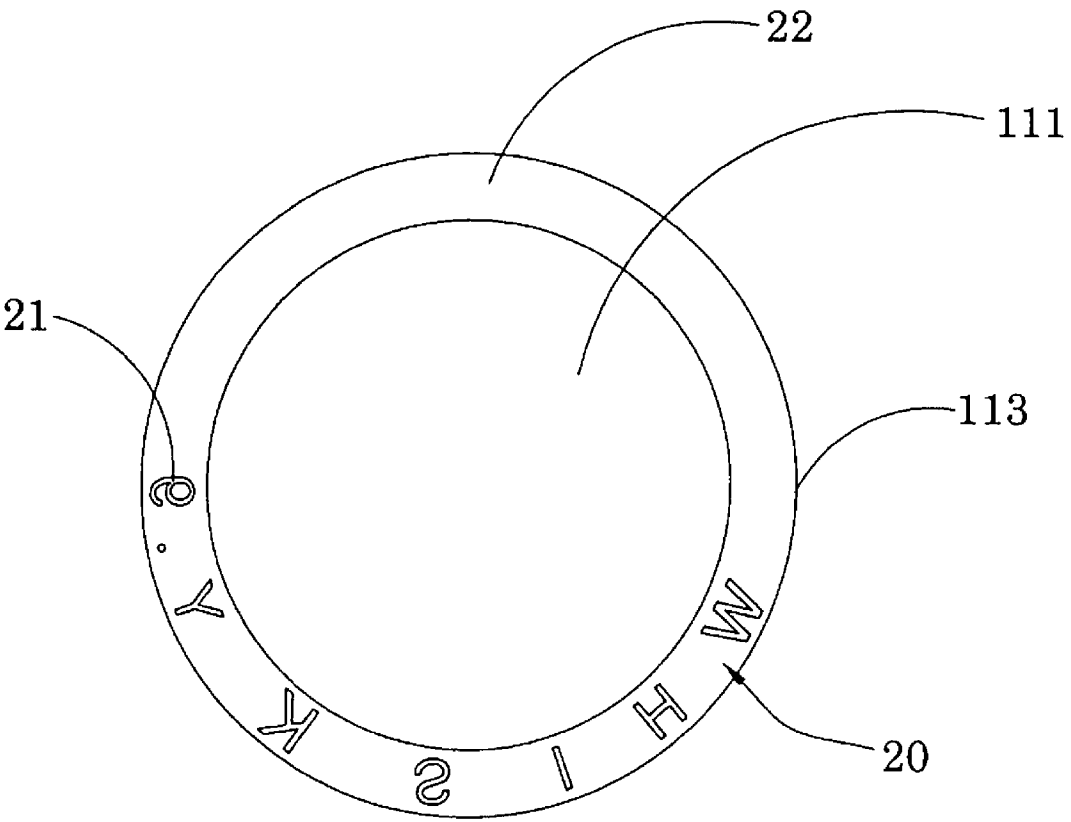
FIG. 5 is a bottom view of an embodiment of the present invention illustrating the characters form on the bottom of the container.

In order to have a required presentation, the image characters 21 need to be formed in an inversed manner on the refraction face 22. As illustrated in FIG. 5, the left and right of a character are reversed. The sequence of a serial of characters 21 is also left and right reversed. Because the material of the solid base 11 of the container is transparent, the image characters 21 on the refraction face 22 can be seen through the surround wall of the container.

The purpose to have the bottom face concaved and to provide a refraction face 22 is because of the refraction effect. When wave passes from one medium into another of different density, the direction of the wave will change. Because typically the material of the container has a higher density than air, when light ray passes from the material of the container to the air, it will bend away from the normal of the interface. In another word, the light ray in the material of the container is closer to the normal than the ray in the air. As a result, if the bottom of the container is flat, when a user is looking at the bottom of the container from a higher level which happens at most of the time, he will see the image far away from the edge because of the refraction, and the image characters 21 will be squeezed and distorted. The longer distance also reduces the transparency. If the user looks at the bottom of the container at a low level, he can not see any image characters 21 on the bottom. In this situation, because of refraction, the image characters 21 on the peripheral of the bottom can only be seen from a limited range of directions. Look at the container from the most possible directions, the image characters 21 presented on the surrounding face 113 will be distorted and unclear.

Referring to FIG. 3, in the present invention, the refraction face 22 on the bottom concave face 111 lifts the image characters 21 on the bottom closer to the surrounding face 113 of the solid base 11, and the refraction angle 15 is also decreased. Therefore, the image characters 21 on the peripheral portion are easy to be seen from the surrounding face 113, the distortion is also limited.

It is worth mentioning, the solid base 11 of the present invention needs to maintain a predetermined thickness. Therefore, the light ray can pass from the image characters 21 to the surrounding face 113, preferably, to the viewing face 23 directly. If the solid base 11 is not thick enough, the light ray will pass through the solid base 11, then enter into the container cavity 13, then enter into the surrounding wall 12. There will be two more interfaces which will distort and weak the image presentation largely. Because of the refraction face 22, complex characters 21, such as letters can be presented clearly on the viewing face 23, as illustrated in FIG. 3. Alternatively, the thickness of the solid base is limited so the light ray will be refracted by multiple interfaces to get special effects.

It is worth mentioning, the view face 23 of the image presentation arrangement 20 could be a portion of the surrounding face 113 of the solid base 11. The surface of the surrounding face 113 is flat and continuous. The viewing face covers the effective area whereon users and easily see the image presentation from a normal angle. In another word, when a user looks at the container from a range of direction, for example, from 20° to 80° downwardly, the user can see the image presented on the viewing face by refraction.

Alternatively, the viewing face 23 can have different contour from the surrounding face 113. For example, the viewing face may concave or convex from the surrounding face 113 to provide a preferred refraction angle and a preferred image presentation.

The bottom concave face 111 also provides a cavity at the bottom of the container. This cavity can retain a light source or other equipments or features for image presentation improvement. For example, as illustrated in FIG. 4, a plurality of LEDs 24 are provided in the cavity at the bottom of the container. The light ray generated by the LED will provide special effect of the image presentation.

In summary, the present invention doesn't affect the features of the surround wall of the containers. To use the present invention, the shape and surface features of the container will not be changed. It uses the reflection and refraction effects of the light to provide a special effect of presenting designated image characters, such as trade mark, or manufacturer. The user may be attracted by the image presentation to remember the mark to achieve an advertisement result. The invention is low cost, and easy to realize. The selection of available methods to prepare the image characters on the solid base is large. The presentation of the image is flexible and effective.

One skilled in the art will understand that the embodiment of the present invention as shown in the drawings and described above is exemplary only and not intended to be limiting.

It will thus be seen that the objects of the present invention have been fully and effectively accomplished. It embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A container, comprising:

a container body comprising a solid base made of transparent material and a surrounding wall upwardly extended from said solid base to define a container cavity within said surrounding wall, wherein said solid base has a refraction face at a bottom face of said solid base and a viewing face at an outer surrounding face of said solid base to define a refraction angle between said refraction face and said viewing face; and an image presentation arrangement which comprises one or more characters integrally formed at said refraction face of said solid base, wherein virtual images of said characters are projected on said viewing surface by means of refraction for enhancing a decorative aesthetic appearance of said container body.

2. The container, as recited in claim 1, wherein said characters are configured in an inversed manner.

3. The container, as recited in claim 2, wherein said characters are reversed left and right on said refraction face of said solid base and a sequence of a serial of said characters are also reversed.

4. The container, as recited in claim 1, wherein said bottom face of said solid base is a concave surface that said characters are formed a peripheral portion of said bottom face of said solid base.

5. The container, as recited in claim 3, wherein said bottom face of said solid base is a concave surface that said characters are formed a peripheral portion of said bottom face of said solid base.

6. The container, as recited in claim 1, wherein said bottom face of said solid base has a trapezoid shape defining a top flat surface and an inclined flat surface, wherein said characters are formed said inclined flat surface of said bottom face of said solid base.

7. The container, as recited in claim 3, wherein said bottom face of said solid base has a trapezoid shape defining a top flat surface and an inclined flat surface, wherein said characters are formed said inclined flat surface of said bottom face of said solid base.

8. The container, as recited in claim 1, wherein said refraction angle between said refraction face and said viewing face is lesser than an angle between said surrounding face of said solid base and a ground level where said container body stands.

9. The container, as recited in claim 5, wherein said refraction angle between said refraction face and said viewing face is lesser than an angle between said surrounding face of said solid base and a ground level where said container body stands.

10. The container, as recited in claim 7, wherein said refraction angle between said refraction face and said viewing face is lesser than an angle between said surrounding face of said solid base and a ground level where said container body stands.

11. The container, as recited in claim 1, wherein said characters are integrally formed at said refraction face of said solid base by one of embossment, engraving, and enchasing.

12. The container, as recited in claim 9, wherein said characters are integrally formed at said refraction face of said solid base by one of embossment, engraving, and enchasing.

13. The container, as recited in claim 10, wherein said characters are integrally formed at said refraction face of said solid base by one of embossment, engraving, and enchasing.

14. The container, as recited in claim 1, wherein said characters are integrally protruded from said refraction face of said solid base.

15. The container, as recited in claim 9, wherein said characters are integrally protruded from said refraction face of said solid base.

16. The container, as recited in claim 10, wherein said characters are integrally protruded from said refraction face of said solid base.

17. The container, as recited in claim 15, wherein said solid base of said container body is made of transparent material selected from the group consisting of glass, crystal, plastic, and acryl.

18. The container, as recited in claim 16, wherein said solid base of said container body is made of transparent material selected from the group consisting of glass, crystal, plastic, and acryl.

19. The container, as recited in claim 17, further comprising a light source supported within a cavity within said bottom face of said container body for generating a light effect at said characters being projected on said viewing face.

20. The container, as recited in claim 18, further comprising a light source supported within a cavity within said bottom face of said container body for generating a light effect at said characters being projected on said viewing face.

* * * * *